US005438626A

United States Patent [19]

Neuman et al.

[11] Patent Number: 5,438,626

[45] Date of Patent: Aug. 1, 1995

[54] COLLAPSIBLE HEARING DEVICE

[76] Inventors: Bernard Neuman; Sandra J. Neuman, both of 7972-A Lexington Club, Delray Beach, Fla. 33446

[21] Appl. No.: 157,904

[22] Filed: Nov. 24, 1993

[51] Int. Cl.[6] ..... H04R 25/00

[52] U.S. Cl. ..... 381/183; 381/187; 381/25

[58] Field of Search ..... 381/183, 187, 81, 25, 381/68, 69, 69.2, 68.5; 379/63, 430

[56] References Cited

U.S. PATENT DOCUMENTS

| | | | |
|---|---|---|---|
| 3,906,160 | 9/1975 | Nakamura et al. | 381/25 |
| 4,409,442 | 10/1983 | Kamimura | 179/156 |
| 4,445,005 | 4/1984 | Furuhashi | 179/156 |
| 4,463,223 | 7/1984 | Yamanoi et al. | 179/156 |
| 4,465,907 | 8/1984 | Minear et al. | 381/81 |
| 4,517,418 | 5/1985 | Baran et al. | 179/156 |
| 4,571,746 | 2/1986 | Gorike | 2/209 |
| 4,597,469 | 7/1986 | Nagashima | 181/129 |
| 4,609,786 | 9/1986 | Omoto et al. | 179/156 |
| 4,633,498 | 12/1986 | Warnke et al. | 381/25 |
| 5,027,433 | 6/1991 | Menadier et al. | 455/606 |
| 5,095,382 | 3/1992 | Abe | 359/189 |
| 5,099,519 | 3/1992 | Guan | 381/183 |
| 5,177,784 | 4/1993 | Hu et al. | 381/183 |
| 5,253,095 | 10/1993 | Menadier et al. | 359/174 |

OTHER PUBLICATIONS

Nady Systems, Inc., "Introductory Product Bulletin NADY IR-310", Mar., 1993, 2 pages.

Sound Associates, Inc., "Don't Miss A Word SA 500 Infrared Headset", No date, 2 pages.

Wanstonic IR-98 product brochure, "Headphones", No date, 1 page.

*Primary Examiner*—Curtis Kuntz

*Assistant Examiner*—Sinh Tran

*Attorney, Agent, or Firm*—Alvin S. Blum

[57] ABSTRACT

A collapsible hearing device comprising a base housing and a pair of jointed elongated extension arms constructed and arranged with pivots so located that when said arms are unfolded outward, a pair of earphones fixed to a distal end of each arm engages the ears of a user, and when said arms are folded inward, they essentially hug at least a portion of the perimeter of the base housing and form a structure with the base housing sufficiently small to fit into a storage case whose size approximates that of an eyeglass case. Switch means is provided to automatically disengage a power source when the device is folded for storage and to cause the device to be energized when the device is unfolded for use. Optionally, the base housing may have lower corner portions recessed in outline to receive said earphones when said arms are folded inward.

17 Claims, 3 Drawing Sheets

COLLAPSIBLE HEARING DEVICE

BACKGROUND OF THE INVENTION

1. Field of the Invention

This invention relates to hearing devices, and particularly those used by hearing impaired people while attending concerts, plays and other entertainment or educational affairs in an enclosed environment such as a theater, auditorium or other assembly room where acoustical aid is needed. A number of products are available to help people with hearing impairments to overcome their poor hearing.

One class of equipment for overcoming hearing problems comprises a receiver supported by the head of a user and a pair of earphones supported adjacent to the ears of the user. This prior art equipment also includes a housing containing a receiver, such as an FM or infrared sensor or the like, which responds to signals emitted by a transmitter. This equipment also contains means to amplify the signal and convert it to energy that drives the earphones mounted on or in a user's ears. A power source such as a battery is also included in the prior art equipment.

2. Description of the Prior Art

A novelty search of the patented art relating to hearing devices, and particularly, those that are capable of moving between an expanded operational configuration and a contracted configuration for storage when not in use, discovered the following patents: U.S. Pat. No. 4,409,442, issued Oct. 11, 1983 to Kamimura; U.S. Pat. No. 4,445,005, issued Apr. 24, 1984 to Furuhashi; U.S. Pat. No. 4,463,223, issued Jul. 31, 1984 to Yamanoi et al.; U.S. Pat. No. 4,465,907, issued Aug. 14, 1984 to Minear et al.; U.S. Pat. No. 4,517,418, issued May 14, 1985 to Baran et al.; U.S. Pat. No. 4,571,746, issued Feb. 25, 1986 to Görike; U.S. Pat. No. 4,597,469, issued Jul. 1, 1986 to Nagashima; U.S. Pat. No. 4,609,786, issued Sep. 2, 1986 to Omoto et al.; U.S. Pat. No. 5,027,433, issued Jun. 25, 1991 to Menadier et al.; U.S. Pat. No. 5,095,382, issued Mar. 10, 1992 to Abe; U.S. Pat. No. 5,099,519, issued Mar. 24, 1992 to Guan; and U.S. Pat. No. 5,253,095, issued Oct. 12, 1993 to Menadier et al.

None of the patents found in the novelty search discloses a collapsible hearing device comprising a base housing constructed and arranged to have dimensions sufficiently small to fit inside a case on the order of magnitude of an eyeglass case and also provided with a pair of jointed extension arms each constructed and arranged with a pivot pivotally connecting a distal portion of said extension arm to its proximal portion. The distal portion carries an earphone tip thereon. The structural elements of the prior art devices shown in the enumerated patents are not capable of folding inward from an unfolded configuration when in use to a closed configuration in which the portions of the extension arms encompass the base housing in such a closely hugging relation that the device when closed is capable of fitting within a storage case whose size approximates that of an eyeglass case.

Because of the novel construction of the collapsible hearing device of this invention, it is possible for a theater to store many cases containing hearing devices in a storage space considerably smaller than was required for the large hearing devices of the prior art. Also, for those users who prefer to carry their personal hearing devices with them, it is much more convenient for them to carry their hearing device in a carrier case of a size comparable to an eyeglass case than the bulkier devices of the prior art.

In addition, many of the patented hearing devices of the prior art are constructed and arranged to fit over the head of a user. Such constructions pose a problem of grooming, particularly with women, since the hair engaging structural element of the hearing device tends to spoil a woman's hairdo when the device is used. While the headset of this invention can be worn over the head if the user cares to do so, the present invention makes it possible for a user to wear the hearing device under the chin without disturbing any hairdo.

BRIEF DESCRIPTION OF THIS INVENTION

This invention provides a new and useful device having different structural features of different construction and arrangement from those of the prior art devices. These novel structural features are particularly useful when the hearing device contains a base housing smaller than those required for the relatively large circuit elements of the prior art that have been replaced with miniaturized circuit elements that form part of the improved state of the art.

In a preferred embodiment of this invention, each earpiece is fixed to a distal end of an elongated jointed extension arm and each extension arm is pivotally attached at its proximal end to a base housing by one or another of a pair of proximal pivots. Each elongated extension arm is provided with a distal pivot that converts its associated extension arm into a jointed arm having two arm portions, a long proximal portion and a short distal portion hinged to one another. The extension arms are constructed and arranged in such a manner that the arm portions pivot outward into positions for use wherein the earphones are aligned with the ears of the user, and are also capable of pivoting into a closed position around the base housing for storing the closed device within a case whose size approximates that of an eyeglass case. In order to make it possible to attain this goal of storing the device within such a small storage case when not in use, it is necessary to construct and arrange the elements of the hearing device in such a manner that the jointed arms and earphones carried by the distal ends thereof enclose the base housing containing the noise-sensitive elements of the hearing device as well as a power source contained within the base housing so closely as to essentially hug the top, the upper corners and the side walls of the base housing.

This hugging feature not found in the prior art devices makes it more convenient for a user who owns a hearing device to carry it from home to an auditorium, and/or makes it more convenient for a theater or auditorium to store a plurality of such hearing devices in a relatively small area of the theater or auditorium when local statutes require theater or auditorium owners to have hearing devices available for members of the audience who require help to overcome hearing problems. In a preferred embodiment of this invention, the elongated extension arms that carry the earphones at their distal ends have distal pivots that divide the elongated arms into proximal arm portions having a length approximating the length of the base housing and distal arm portions having a length approximating those of the left and right side walls of the base housing. In addition, the lower left and right corner portions of the base housing may be recessed to receive the earpieces fixed to the distal ends of the elongated arms.

The present invention may also include automatic switch means that cooperates with the power source that makes the device operate to disconnect the power source from the device automatically whenever the device is folded to a closed configuration for storage and limits the use of the power source only to those times when the device is unfolded to its open configuration for operation. This additional feature assures that the power source does not lose its strength and operability prematurely.

In its broadest scope, each jointed extension arm of this invention comprises a proximal arm portion and a distal arm portion pivoted to said proximal arm portion at a distal pivot spaced from a proximal pivot of said jointed extension arm where the latter extends from the base housing. The distal pivot and proximal posit of a given arm are arranged to rotate in a common first direction for extension and in a common, opposite direction for folding into a compact configuration. The proximal and distal portions of a given arm lie in a common plane in both folded and extended configurations.

The aforesaid and other benefits of this invention will become obvious in the light of a description of a preferred embodiment thereof that follows.

BRIEF DESCRIPTION OF THE DRAWINGS

In the drawings forming part of a description of a preferred embodiment that follows, and where like reference numerals refer to like structural elements.

DETAILED DESCRIPTION OF A PREFERRED EMBODIMENT

Figure 1:
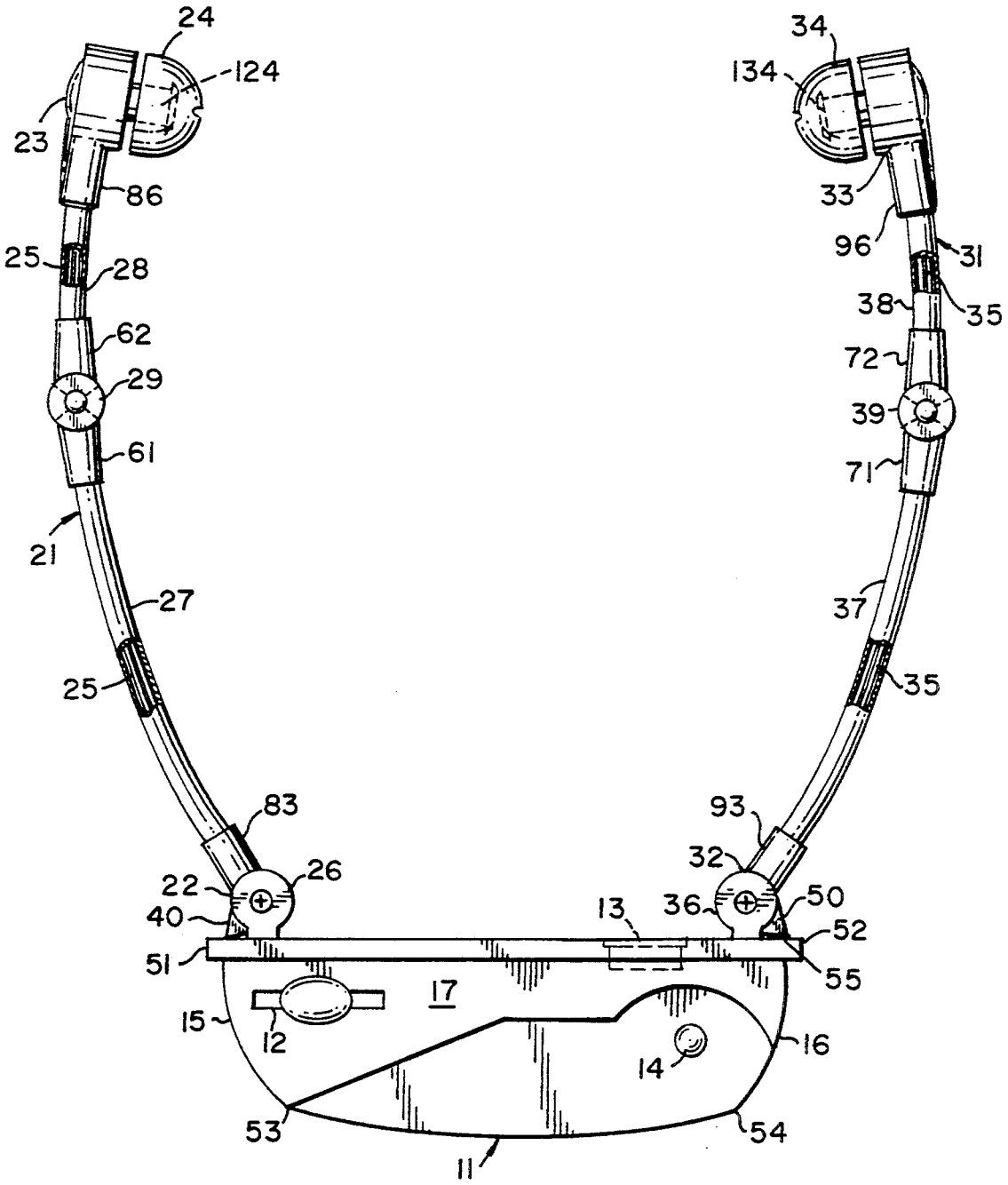
FIG. 1 is an elevational view with parts exposed of a hearing device of this invention in its open unfolded configuration ready for use.

Referring to the drawings, a hearing device conforming to a preferred embodiment of this invention comprises a base housing (11) constructed and arranged to support electronic decoder means (102) shown in phantom, a volume control (12), a removable and replaceable power source (13) such as a battery pack or the like, and an infrared or FM radio receiver (14) therewithin. Base housing (11) has a top wall (110), a left side wall (15), a right side wall (16), a front wall (17) and a rear wall (18) not shown. Front wall (17) is apertured in front of a position occupied by infrared or FM receiver (14) so as to enable the latter to be exposed to a source of radiant energy (not shown). The remainder of walls (15), (16), (18) and (110) are opaque to the energy sensed by receiver (14). Housing (11) has an upper left corner portion (51), an upper right corner portion (52), a lower left corner portion (53) and a lower right corner portion (54).

The terms "left" and "right" refer to the orientation of the various elements of the illustrative device as seen by a person looking at the front side of a user. Consequently, when the device is worn by a user, each element of the device shown on the left side of the device in the drawing is carried to the right side of the user, and each element shown on the right side of the device in the drawing is carried to the left side of the user.

A left, jointed earphone extension arm (21) having a proximal end (22) and a distal end (23) is longitudinally apertured along its length to receive a pair of electroconductive wires (25), and is pivoted to the upper left corner portion (51) of base housing (11) at a proximal pivot (26). Extension arm (21) has a proximal portion (27) and a distal portion (28) pivoted to portion (27) at a distal pivot (29). In addition, an earphone (24) is fixed to distal end (23) of arm (21) to extend inward from distal end (23) into the right ear of a user.

The device is also provided with a right, jointed earphone extension arm (31) having a proximal end (32) corresponding to proximal end (22) of left extension arm (21), a distal end (33) corresponding to distal end (23), and is longitudinally apertured along its length to receive electroconductive wires (35) corresponding to wires (25). Right, jointed extension arm (31) is pivoted to upper right corner portion (52) of base housing (11) at a proximal pivot (36) corresponding to proximal pivot (26). Extension arm (31) has a proximal portion (37) pivoted to a distal portion (38) at a distal pivot (39). In addition, an earphone (34) extends inward toward earphone tip (24), so that both ears of a user are simultaneously engaged by earphones (24) and (34) when extension arms (21) and (31) are unfolded away from one another. Earphones (24) and (34) include earphone tips (124) and (134), shown in phantom.

Figure 2:
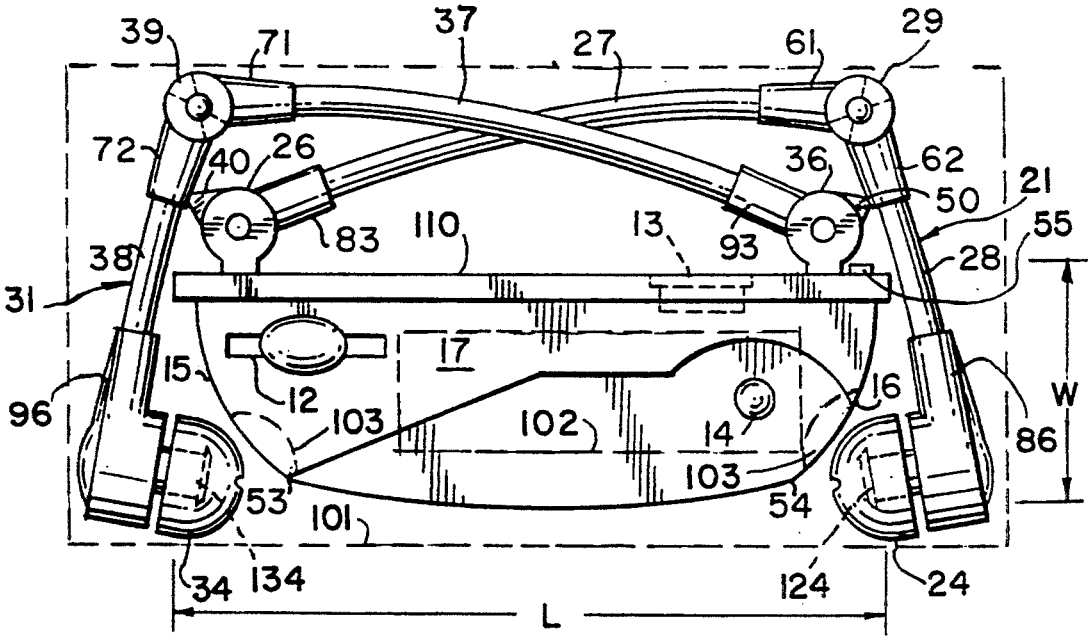
FIG. 2 is a view similar to FIG. 1, showing the FIG. 1 device folded to its closed configuration wherein the elongated arm portions that support the earphones at their distal ends are folded into a closed position wherein the device is capable of storage within a small storage case of a size approximating that required for storing a set of eyeglasses.

Jointed arm (31) is pivoted inwardly into a closed configuration around base housing (11) for storage in a small storage case whose size is on the order of magnitude of an eyeglass case. When jointed extension arm (31) is folded inward, its proximal portion (37) extends along the length (L) of base housing (11) in close relation thereto from adjacent right upper corner portion (52) to adjacent upper left corner portion (51), distal portion (38) extends along the width(W) of left side wall (15) from adjacent upper left corner portion (51) to adjacent lower left corner position (53), and earphone tip (134) reaches a position closely adjacent to the left bottom corner portion (53) of base housing (11) as shown in FIG. 2.

Also, in this closed configuration, proximal portion (27) of left jointed extension arm (21) extends along the length of the top wall (110) of base housing (11) from a position adjacent upper left corner portion (51) to a position adjacent upper right corner portion (52), distal portion (28) of left jointed extension arm (21) extends downward along the right side wall (16) from a position adjacent upper right corner portion (52) to a position adjacent lower right corner portion (54), and earphone tip (24) reaches a position closely adjacent the right bottom corner portion (54) of base housing (11) with portions (27) and (28) of left extension arm (21) closely adjacent to the top wall (110) and right side wall (16) of base housing (11). This folded configuration enables the device to fit in a case (101) shown in phantom, while guarding the earpiece from trauma and contamination when not in use in the ear canals.

In other words, this invention suggests that the jointed extension arms be constructed and arranged so that proximal portions (27) and (37) have lengths approximating the length of base housing (11) and the distal portions (28) and (38) have lengths approximating the length of side walls (15) and (16) of base housing (11). Thus when arms (21) and (31) are folded, they embrace base housing (11) in a substantially hugging relationship that not only insures a compact configuration for the device when not in use, but it also enables the relatively rigid structure of housing (11) to reinforce the relatively fragile structures of arms (21) and (31). If desirable, lower corner portions (53) and (54) may be recessed in outline to receive earphones (34) and (24) in the folded configuration.

A knob (40) to be discussed later is provided in the vicinity of proximal pivot (26). Another knob (50) in the vicinity of proximal pivot (36) symmetrical to knob (40) is engaged by distal portion (28) of extension arm (21) when the latter is folded. Knobs (40) and (50) are so constructed and arranged that a selected one of knobs (40) or (50) turns an associated switch (55) on when arms (21) and (31) are unfolded outward and earphones (24) and (34) are applied to the ears of a user. When arms (21) and (31) are folded inward, said knob (40) or (50) turns its associated switch (55) off to enable the life of power source (13) to be extended. Knob (40) is not associated with a switch, but is included with the parts of the device to simplify the inventory of parts to assemble the device.

Figure 3:
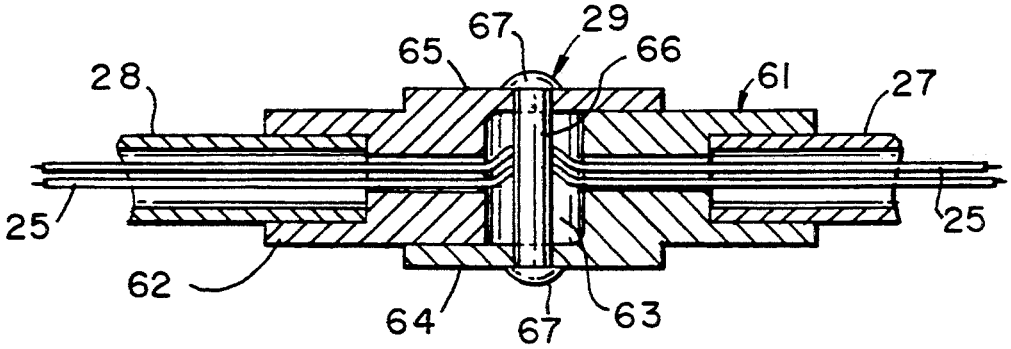
FIG. 3 is a view partially broken away in section taken along line 3—3 from FIG. 4 of a portion of one of a pair of elongated extension arms taken in the vicinity of a distal pivot for said elongated extension arm.
Figure 4:
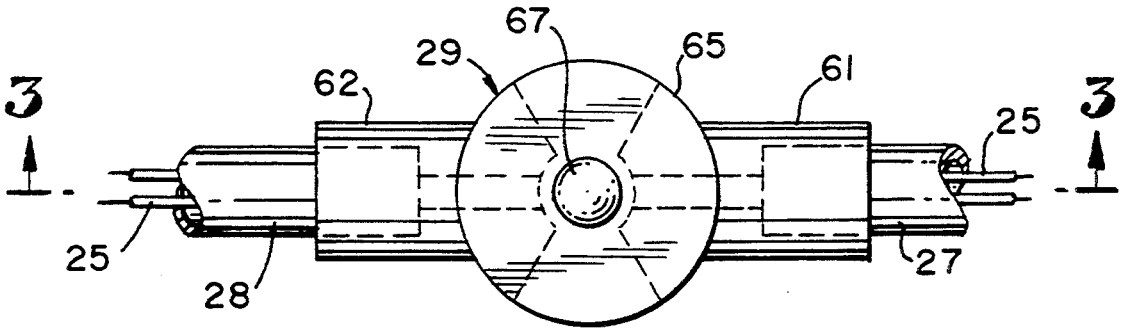
FIG. 4 is a plan view of the pivot 29.

Referring to FIGS. 3 and 4, the details of the structure of distal pivots (29) and (39) will be described. Apertured extension sleeves (61) and (62) are fit over the adjacent ends of elongated arm portions (27) and (28), respectively. A chamber (63) is formed between a radially apertured extension (64) of sleeve (61) and radially apertured extension (65) of sleeve (62). The latter extension (65) extends in the opposite direction from former extension (64). The radial apertures of radially apertured extensions (64) and (65) receive a pin (66) having enlarged heads (67) at both ends thereof. Thus, the axis of pin (66) is the axis for distal pivot (29). Chamber (63) is sufficiently large to enable portions (27) and (28) to pivot relative to one another without disturbing the portions of wires (25) that extend around pin (66) within chamber (63).

Returning to FIG. 1, distal pivot (39) for jointed earphone extension arm (31) is arranged as a mirror image of the structures of distal pivot (29) for jointed earphone extension arm (21), with apertured extension sleeves (71) and (72) serving the same purpose for distal pivot (39) as sleeves (61) and (62) perform for distal pivot (29).

Extension sleeve (61) and reinforcement (83) strengthen the distal and proximal ends of arm portion (27), respectively. Extension sleeve (62) and reinforcement (86) do likewise for the proximal and distal ends of arm portion (28). Furthermore, extension sleeves (71) and (72) and reinforcements (93) and (96) strengthen the corresponding ends of arm portions (37) and (38) of arm (31). Such strengthening reduces the likelihood of breakage when the elongated extension arms are connected to one another and to base housing (11) during assembly of the device.

Figure 5:
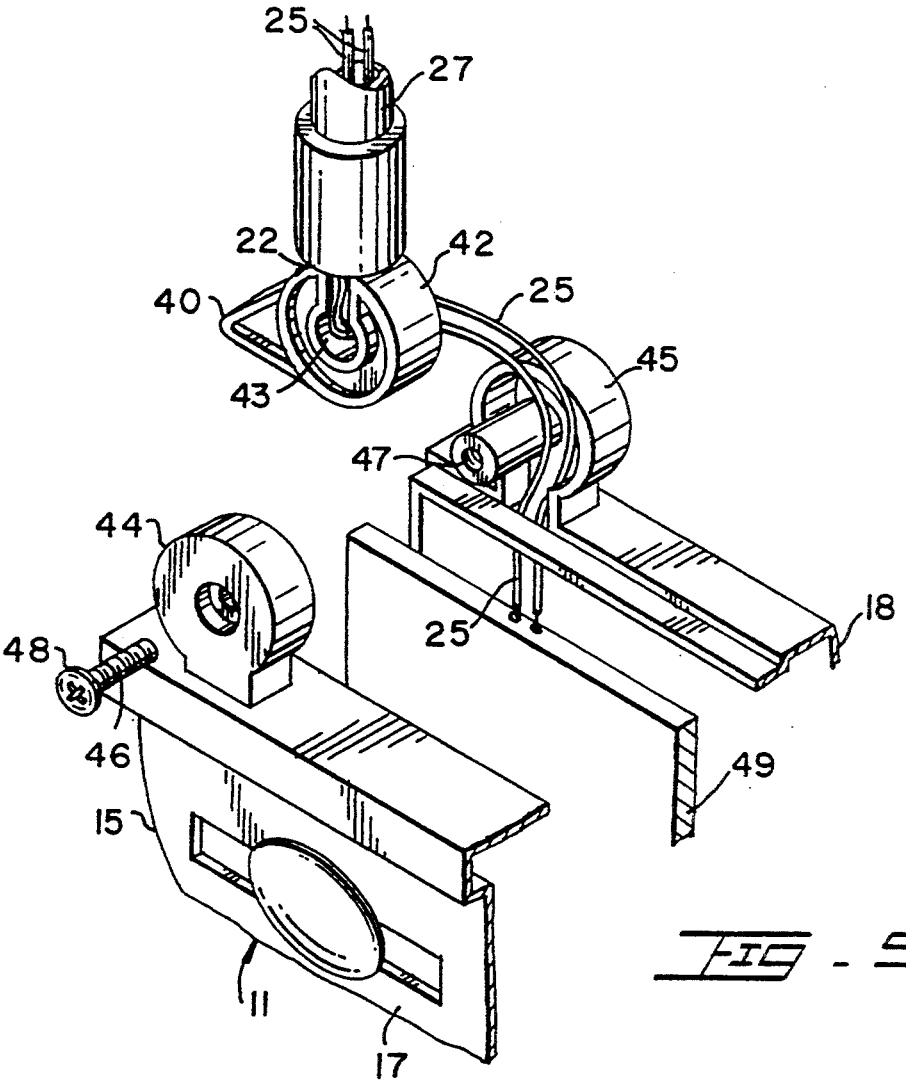
FIG. 5 is an exploded perspective view near a proximal pivot between the proximal end of one of the elongated extension arms and a base housing.

Referring to FIG. 5, the reader can understand the construction of a proximal pivot (26) between proximal end (22) of proximal portion (27) of left, jointed earphone extension arm (21) and the upper left corner portion (51) of base housing (11) from the description that follows. It is also the basis for similar mirror-image structure for pivotally connecting proximal end (32) of proximal portion (37) of right, jointed earphone extension arm (31) to the upper right corner portion (52) of base housing (11).

Knob (40) is carried near the perimeter of an axially apertured disc housing (42) that defines an outer surface of a chamber (43). The latter is located in the proximal direction axially of proximal end (22) with the transverse dimension of housing (43) extending between a pair of aligned apertured bosses (44) and (45). The latter extend obliquely outward from the upper left-hand corner portion (51) of front wall (17) and rear wall (18) of base housing (11). An externally threaded screw (46) engages an internally threaded, transversely extending sleeve (47). Screw (46) has a slotted head (48) that facilitates engagement of screw (46) and sleeve (47).

An electronic board (49) carriers infrared or FM radio sensing, amplifying and decoding means for converting the sensed radiation into audio signals to the earphones. It is supported within base housing (11), and wires (25) are connected at their proximal ends to a left upper corner portion of said electronic board (49). Bosses (44) and (45) are constructed and arranged to provide chamber (43) with a circumferential configuration around sleeve (47) and between the inner surface of sleeve (47) and disc housing (42) to allow wires (25) clearance to pass from the upper left corner portion (51) of base housing (11) to left earphone extension arm (21), and around internally threaded sleeve (47) in chamber (43) without disturbing the continuity of wires (25) when proximal arm portion (27) pivots. A similar construction for pivotally connecting proximal end (32) of elongated extension arm (31) to upper right corner portion (52) and wires (35) to the upper right corner portion of electronic board (49) is also included in the preferred embodiment, except that the construction provided for clearance for wires (35) is the mirror image of the construction provided for the clearance for wires (25).

Each of the movable elements of the device, such as arm portions (27) and (28) of jointed arm (21) and arm portions (37) and (38) of jointed arm (31) are mirror images of corresponding portions of one another, including their respective sleeves (61), (62), (71) and (72) and their reinforcements (83), (86), (93) and (96). This feature facilitates the manufacture of the device and allows the use of either knob (40) or knob (50) to actuate switch (55) that controls operation of power source (13), depending on the location of switch (55). In FIG. 1, knob (50) is shown engaging switch (55) to actuate power source (13) when the device is in use. In FIG. 2, knob (50) is offset from switch (55), so that power source (13) is deactivated when the device is folded inward for storage. Knob (40) may be used to actuate a switch if the latter is located in position for actuation by knob (40) rather than knob (50).

The construction and arrangement of the preferred embodiment of this invention represents an improvement over prior art collapsible hearing devices, because the prior art devices of which the inventors are aware do not collapse the earphones supporting elongated arms sufficiently to enable folded arms of prior art devices to essentially hug the perimeter of a base housing. It is suggested that the failure of prior art hearing devices to collapse into such close adjacency to the base housing for the devices lies in the absence of a pair of pivots conforming to this invention, namely, a proximal pivot for each arm that pivotally attaches a proximal end of an elongated arm to one upper corner portion of a base housing and a distal pivot located in position along the length of each arm to divide each arm into two arm portions pivoted to one another to convert each arm into a proximal portion having a length approximating the length of the base housing and a distal portion having a length approximating the height of the base housing. In addition, the prior art patents fail to anticipate the combination of switch means constructed and arranged relative to the elongated pivoted extension arms in such a manner that said arms disconnect the power source when the extension arms are folded inward away from their configuration while the device is in use. Also, the prior art fails to show an optional feature of this invention to provide recessed lower corner portions for the base housing to receive the earphones carried at the distal ends of the arms.

Conforming to the requirements of the patent statutes, applicants have described the principles of this invention and disclosed the details presently considered to be included in a preferred embodiment thereof. However, it is understood that the disclosure is illustrative only and that the invention many be modified within the scope of the claimed subject that follows without departing from the gist of this invention.

What is claimed is:

1. A collapsible hearing device comprising a base housing constructed and arranged to fit in a storage case having length and width dimensions approximating those of a storage case for a pair of eyeglasses, said housing being sufficiently large to enclose electronic decoder means, FM radio or infrared radiation sensing means and a power source therewithin, a pair of elongated extension arms, each having a long proximal portion, a short distal portion, a distal pivot pivotally connecting a distal end of said proximal portion to a proximal end of said distal portion, and an earphone fixed to a distal end of said distal portion, each one of said pair of elongated extension arms being so constructed and arranged to fold into a compact configuration having the folded arm portions extending around said base housing in close adjacency, with said proximal portion transverse to said distal portion, said proximal portion adjacent a top wall of said base housing, said distal portion adjacent one of two side walls side of said base housing, and each earphone protectively adjacent said housing.

2. A device as set forth in claim 1 further including a proximal pivot pivotally connecting a proximal end of each said proximal portion to said base housing, distal pivot and the proximal pivot rotating in a common first direction for extension and in a common second direction for folding.

3. A device as set forth in claim 2, wherein said pair of elongated extension arms includes a left elongated extension arm and a right elongated extension arm, said two side wall including a left side wall and a right side wall said base housing further including a front wall, a rear wall, an upper left corner portion and an upper right corner portion, said proximal pivot for said left elongated extension arm being at said upper left corner portion, said proximal pivot for said right elongated extension arm being at said upper right corner portion, said proximal portions of said left and right extension arms having lengths approximating the length dimension of said base housing, and said distal portions of said left and right extension arms having lengths approximating the length dimensions of said left and right side walls.

4. A device as set forth in claim 3, wherein said base housing has a lower left corner portion and a lower right corner portion, the corner portions being recessed to protectively receive said earphones fixed to the distal ends of said distal portions of said elongated extension arms.

5. A device as set forth in claim 2, wherein each of the arm portions is longitudinally apertured to receive wiring, and each of the pivots includes a chamber enclosing a pivot pin leaving sufficient clearance within said chamber to draw said wiring therethrough and permit the arm portions to pivot about their corresponding pivots without disturbing the continuity of said wiring.

6. A device as set forth in claim 3, wherein said front wall has an aperture aligned with a position occupied by said sensing means carried within said base housing to expose said sensing means to a source of energy.

7. A device as set forth in claim 1, wherein said elongated extension arms are constructed and arranged to unfold into an extended configuration, wherein said earphones are aligned with the ears of a user.

8. A device as set forth in claim 7, further including switch means carried by said base housing and actuating means in position to operate said switch means when at least one of said pair of elongated extension arms pivots between folded and extended positions.

9. A device as set forth in claim 1, wherein each of the arm portions is longitudinally apertured to receive wiring, and each of the pivots includes a chamber enclosing a pivot pin leaving sufficient clearance within said chamber to draw said wiring therethrough and permit the arm portions to pivot about their corresponding pivots without disturbing the continuity of said wiring.

10. A device as set forth in claim 1, wherein said base housing has a front wall having an aperture aligned with a position occupied by said sensing means to expose said sensing means to a source of energy.

11. A collapsible hearing device comprising a base housing enclosing a power source, a pair of jointed elongated extension arms, each having a proximal pivot pivotally connecting a proximal end of each of said jointed elongated extension arms to said base housing for movement between a compact configuration in which each arm substantially embraces two transverse sides of the perimeter of said base housing and an open configuration in which said jointed elongated extension arms are spaced from said base housing, and an earphone carried at a distal end of each said jointed elongated extension arm, said base housing having given length and width dimensions and each of said jointed, elongated extension arms is provided with a distal pivot along its length so located that each said distal pivot divides its associated extension arm into a long proximal arm portion having a length approximating said given length dimension of said base housing and a short distal arm portion having a length approximating that of said width dimension of said base housing.

12. A device as set forth in claim 11, wherein said elongated extension arms are constructed and arranged to align said earphones at said distal ends thereof with the ears of a user in said open configuration, and to position each of said earphones protectively against said base housing when in said compact configuration.

13. A device as set forth in claim 11, further including switch means carried by said base housing and actuator means constructed and arranged to activate said switch means when said elongated extension arms are unfolded into said open configuration and to deactivate said switches means when said elongated extension arms are folded into said compact configuration.

14. A device as set forth in claim 11, wherein each of the arm portions is longitudinally apertured to receive wiring, and each of the pivots includes a chamber enclosing a pivot pin leaving sufficient clearance within said chamber to draw said wiring therethrough and permit the arm portions to pivot about their corresponding pivots without disturbing the continuity of said wiring.

15. A device as set forth in claim 11, wherein said base housing including sensing means and a front wall having an aperture aligned with a position occupied by said sensing means to expose said sensing means to a source of energy.

16. A device as set forth in claim 11, wherein said base housing has a lower left corner portion and a lower right corner portion, the lower corner portions being recessed to protectively receive said earphones fixed to the distal ends of said elongated extension arms when the elongated extension arms move into said compact configuration.

17. A collapsible hearing device having a base housing and a pair of jointed elongated extension arms extending from said base housing, each arm supporting an earphone at a distal end thereof, each of said jointed elongated extension arms having a single distal joint along its length located in such a position that it divides its associated jointed elongated arms into a long proximal arm portion and a short distal arm portion so constructed and arranged that when the arm portions pivot outward relative to said base housing, the earphones engage the ears of a user and when the arm portions pivot inward relative to the base housing, the arm portions move in close adjacency to at least a portion of said base housing, with each of the short distal arm portions transverse to each of the proximal arm portions and each of the earphone protectively adjacent said base housing, wherein said base housing has given length and a given height and each said jointed elongated extension arms has a proximal portion whose length approximates said given length of said base height of said base housing and a distal portion whose length approximates said given height of said base housing.

* * * * *